US005267259A

United States Patent [19]

Gillhaus et al.

[11] Patent Number: 5,267,259

[45] Date of Patent: Nov. 30, 1993

[54] INDUCTION CRUCIBLE FURNACE WITH SONICALLY UNCOUPLED ACCESSIBLE FURNACE PLATFORM

[75] Inventors: Horst Gillhaus; Peter Scheyka; Gerhard Wowries, all of Dortmund, Fed. Rep. of Germany

[73] Assignee: ABB Patent GmbH, Mannheim, Fed. Rep. of Germany

[21] Appl. No.: 919,090

[22] Filed: Jul. 23, 1992

[30] Foreign Application Priority Data

Jul. 30, 1991 [EP] European Pat. Off. ..... 91710026.5

[51] Int. Cl.[5] ..... F27B 14/06; F27B 14/02; F27B 14/12

[52] U.S. Cl. ..... 373/143; 373/8; 266/240; 432/250; 432/157; 181/284

[58] Field of Search ..... 373/8, 9, 143, 138, 373/140; 219/420, 421; 266/240, 242; 432/157, 250; 110/173 R; 181/284, 285, 230; 49/73, 381, 404

[56] References Cited

U.S. PATENT DOCUMENTS

| | | | |
|---|---|---|---|
| 2,525,883 | 10/1950 | Ferguson . | |
| 2,606,016 | 8/1952 | Lindh et al. | 373/8 |
| 3,458,179 | 7/1969 | O'Rourke | 432/157 |
| 3,751,854 | 8/1973 | Huwyler et al. | 110/173 R |
| 3,822,872 | 7/1974 | Nell . | |
| 3,913,898 | 10/1975 | Wolters | 373/9 |
| 3,930,641 | 1/1976 | Overmyer et al. | 373/9 |
| 4,088,824 | 5/1978 | Bonistalli | 373/9 |
| 4,205,197 | 5/1980 | Omori et al. | 266/242 |
| 5,193,998 | 3/1993 | Hack et al. | 432/250 |

FOREIGN PATENT DOCUMENTS

| | | |
|---|---|---|
| 460484 | 5/1991 | European Pat. Off. . |
| 2626161 | 12/1977 | Fed. Rep. of Germany . |
| 2815917 | 10/1979 | Fed. Rep. of Germany . |
| 2944454 | 5/1981 | Fed. Rep. of Germany . |
| 375520 | 7/1907 | France . |
| 61-225573 | 10/1986 | Japan . |

*Primary Examiner*—Bruce A. Reynolds
*Assistant Examiner*—John A. Jeffery
*Attorney, Agent, or Firm*—Herbert L. Lerner; Laurence A. Greenberg

[57] ABSTRACT

An induction crucible furnace with a tiltable furnace body includes a crucible that is usually covered by an accessible furnace platform. The furnace platform is sonically uncoupled from the furnace body in an untilted normal position, in order to reduce sound intensity radiated by the furnace platform. Coupling elements, which effect a change of state between a very loose coupling or a complete uncoupling in the normal position and a close or rigid coupling in a tilted position of the furnace body, are provided between the furnace body and the furnace platform. The coupling elements can be spring elements, lug and bolt connections, lug and bolt and lug connections or lug and locking bolt connections.

35 Claims, 8 Drawing Sheets

INDUCTION CRUCIBLE FURNACE WITH SONICALLY UNCOUPLED ACCESSIBLE FURNACE PLATFORM

The invention relates to an induction crucible furnace with a tiltable furnace body which has a crucible and can be covered by an accessible furnace platform.

Such an induction crucible furnace is known from Brochure No. D ME/D 118289 D of the firm ABB and is suitable for the inductive melting of cast iron, steel, light metal, heavy metal and alloys, with the operation being carried out, for example, at frequencies of from 100 to 1000 Hz in the case of a construction as a medium-frequency induction crucible furnace. A power converter is used for adjusting to an alternating voltage with a preset frequency.

The active part of the induction crucible furnace is a furnace coil having an interior which is lined by a ceramic crucible. The alternating current flowing through the furnace coil generates an alternating magnetic field which, inside the furnace crucible, passes through metallic feed material and, outside the coil, passes through laminated iron packs of magnetic yokes. The alternating magnetic field induces eddy currents in the metallic feed material, in other words electrical energy which is converted into heat. Based on the transformer principle, the furnace absorbs power from the supply mains so that, with continuous energy supply, the feed material is caused to melt. The electromagnetic forces acting on the melt lead to intensive bath motion, which ensures a rapid heat balance and material balance.

Above the furnace body, there is usually an accessible furnace platform. The furnace platform and the furnace body are usually force-lockingly connected to one another, since tilting of the furnace can then be carried out with particular ease. A force-locking connection is one which connects two elements together by force external to the elements, as opposed to a form-locking connection which is provided by the shapes of the elements themselves.

In an induction crucible furnace, there are essentially two vibration exciters:

the furnace coil with the laminated packs (magnetic yokes), and the ceramic crucible with the surface of the melt.

Although the vibration intensity of the furnace coil and the laminated packs can be influenced within certain limits at a given power and frequency, the sound generation of a given ceramic crucible with a given melt can virtually not be influenced with given dimensions, given power and given frequency.

In the known furnace structures, the vibrations are more or less well passed from the vibration sources to the furnace box (furnace casing), from where they are then radiated as sound into the surroundings. A first sound transmission route leads, for example, radially from the furnace coil and the laminated packs to the outer surfaces of the furnace body, which are parallel to the axis of the furnace coil, from where the sound energy is radiated onto the inside of the furnace box. From there, the vibrations are passed through the walls of the furnace box to the outside and radiated from there as sound. Such radial vibrations are dominating and furthermore, they also cause the furnace platform to vibrate, since they deform the furnace platform through elastic bending deformations.

A second sound transmission route leads essentially upwards and downwards parallel to the axis of the furnace coil (axial directions). At the top, the sound is radiated from the furnace platform and a furnace cover into space. In particular, the furnace platform is very suitable as a sound-transmitting body because of its relatively large surface area that is capable of vibration and because of the force-locking tying to the furnace body and very good radiation of the sound energy radiated by the crucible and by the furnace body into space.

With respect to the second sound transmission route (in the axial direction), such an attenuation of vibrations is not possible and, in the known furnace structures, the vibrations of the furnace coil and the ceramic crucible are conducted away with virtually only slight attenuation up to the furnace platform or the furnace surface. The vibrations emanating from the surface of the melt are in many cases radiated onto the furnace cover and from the latter to the outside without any attenuation.

As a result, the furnace platform and the cover are set into vibrations, resulting in considerable noise nuisances. At certain frequencies and high powers, such sound can represent a considerable nuisance for the surroundings.

Although the sound propagation outside the furnace shed can then be reduced by appropriate sound-absorbing devices to such an extent that the neighborhood is no longer disturbed, a problem which remains is that the sound inside the furnace shed represents a considerable, inadmissibly severe stress on the personnel operating the furnace, which can, inter alia, cause damage to health.

It is accordingly an object of the invention to provide an induction crucible furnace with an accessible furnace platform, which overcomes the hereinafore-mentioned disadvantages of the heretofore-known devices of this general type and wherein the sound intensity radiated by the furnace platform is reduced to such an extent that acceptable working conditions prevail all around the induction crucible furnace.

With the foregoing and other objects in view there is provided, in accordance with the invention, an induction crucible furnace assembly, comprising an induction crucible furnace having a furnace body to be moved between a normal or initial untilted position and a tilted position, the furnace body having a crucible, and an accessible furnace platform for covering the furnace body, the furnace platform being sonically uncoupled from the furnace body in the normal position.

The advantages obtainable with the invention are especially that the furnace platform does not have any direct vibration-transmitting force-locking connection to the furnace body in the normal position (working position) of the furnace. The sound transmission route in the axial direction, that is to say in the vertical direction in the normal position of the furnace, is effectively interrupted because of the uncoupling of the furnace body and the furnace platform. In other words, transmission of structure-borne sound is precluded. Moreover, the sound transmissions in a "slanted" sound propagation direction, for example arising from reflections between the furnace body and the furnace box or within the crucible, are interrupted. Overall, the sound radiation emanating from the induction crucible furnace in its normal position is considerably reduced. Nevertheless, by suitably uncoupling and coupling the furnace body and the furnace platform, it is ensured that, in the tilted position, that is to say in a position in which in most cases no electric voltage is applied to the furnace coil (if appropriate with a reduced voltage for supplying "holding power"), there is a force-locking connection between the furnace body and the furnace platform, so that the furnace platform is tilted simultaneously with the furnace body.

In accordance with another feature of the invention, there is provided a furnace box housing the induction crucible furnace, the furnace box having side walls supporting the furnace platform in the normal position.

In accordance with a further feature of the invention, the induction crucible furnace has a back platform additionally supporting the furnace platform in the normal position.

In accordance with an added feature of the invention, there are provided coupling elements disposed between the furnace body and the furnace platform.

In accordance with an additional feature of the invention, the coupling elements effect a change of state between a very loose coupling or complete uncoupling in the normal position and a close or rigid coupling in the tilted position of the furnace body.

In accordance with yet another feature of the invention, the coupling elements are spring elements having spring characteristics automatically effecting the very loose coupling in the normal position and the close coupling in the tilted position.

In accordance with yet a further feature of the invention, the coupling elements are lug and bolt connections for interconnecting two components in the form of the furnace body and the furnace platform, the lug and bolt connections including lugs each having a slot formed therein and each being fixed to one of the components and bolts being joined to the other of the components and engaging in the slots, for automatically force-lockingly connecting the components with the bolt, the slot and the lug by tilting the furnace body, and for uncoupling the components in the normal position.

In accordance with yet an added feature of the invention, the coupling elements are lug, bolt and lug connections each including a first lug having a first slot formed therein and being fixed to the furnace platform, a second lug opposite the first lug having a second slot formed therein and being fixed to the furnace body and a bolt engaging in the first and second slots, for automatically force-lockingly connecting the furnace body and the furnace platform with the first lug, the first slot, the bolt, the second slot and the second lug by tilting the furnace body, and for uncoupling the furnace body and the furnace platform in the normal position.

In accordance with yet an additional feature of the invention, the coupling elements are lug and locking bolt connections for interconnecting two components in the form of the furnace body and the furnace platform, the lug and locking bolt connections including a longitudinally mobile locking bolt joined to one of the components and a lug being fixed to the other of the components and having a bore formed therein in which the locking bolt engages, for force-lockingly connecting the furnace body and the furnace platform during tilting of the furnace body and for disconnecting the furnace body and the furnace platform in the normal position by retraction of the locking bolt.

In accordance with again another feature of the invention, there is provided an air cylinder having the locking bolt.

Such varied uncoupling variants can be used in this case, in which either spring elements or lug/bolt connections with a fixed bolt or lug/locking bolt connections with a mobile locking bolt are active.

In accordance with again a further feature of the invention, the furnace body and the furnace platform each have a mutually independently operable tilting device, such as tilting cylinders.

In accordance with again an added feature of the invention, the tilting devices for the furnace body and the furnace platform have separate tilt bearings being supported separately and having mutually independent but preferably congruent tilting axes.

In accordance with again an additional feature of the invention, the furnace platform has a lower surface with sound-absorbing elements.

In accordance with still another feature of the invention, there is provided a furnace cover having a cover drive being supported on the furnace platform and being uncoupled from the furnace body in the normal position. This is done in order to provide further sonic uncoupling by ensuring that there is no force-locking connection to the furnace body.

In accordance with still a further feature of the invention, the crucible has a crucible opening formed therein, the furnace platform has an opening formed therein above the crucible opening for extracting emissions being formed upon melting, and the furnace platform has an annular channel integrated therein around the opening in the furnace platform.

In accordance with still an added feature of the invention, the annular channel has side and bottom walls and extraction orifices formed in at least one of the walls.

In accordance with still an additional feature of the invention, there is provided a waste air line integrated into the furnace platform, the annular channel leading into the waste air line for removing the extracted emissions.

In accordance with another feature of the invention, the furnace platform has an upper surface and sound-insulating walls being fixed to the upper surface around the opening in the furnace platform.

In accordance with a further feature of the invention, the sound-insulating walls are vertically fixed on the furnace platform.

In accordance with an added feature of the invention, two of the sound-insulating walls are disposed on either side of the furnace cover, and the furnace cover forms a further sound-insulating wall when opened and preferably extending upright.

In accordance with an additional feature of the invention, there is provided an additional sound-insulating wall being fixed to the upper surface of the furnace platform opposite the furnace cover, for impeding sound radiation on all sides with the furnace cover open.

In accordance with yet another feature of the invention, there is provided an additional sound-absorbing element being fixed to a charging device for the induction crucible furnace at a location opposite the furnace cover, for impeding sound radiation on all sides with the furnace cover open.

In accordance with yet a further feature of the invention, the sound-insulating walls have extraction orifices formed therein for extracting the emissions being formed upon melting.

In accordance with yet an added feature of the invention, the furnace platform has waste air ducts integrated therein for removing the emissions extracted through the sound-insulating walls.

In accordance with yet an additional feature of the invention, the furnace platform has a common header integrated therein, into which the waste air line and the waste air ducts lead.

It is thus seen that in order to obtain effective sound attenuation even in those operating cases in which an electric voltage must be applied to the furnace coil and even with the furnace cover opened, the use of sound-insulating walls mounted vertically on the furnace platform on two or three sides around the crucible opening is proposed. The fourth side of the crucible opening is screened for sound attenuation by the opened furnace cover. The sound radiation emanating from the opened crucible is considerably reduced by these measures.

In accordance with again another feature of the invention, the furnace cover has means for attenuating sound energy generated in the crucible.

In accordance with again a further feature of the invention, the furnace cover has a twin-shell construction with an inner shell, an outer shell and sound-attenuating material disposed between the shells.

In accordance with again a further feature of the invention, the crucible has a crucible opening formed therein and a raised rim at the crucible opening, and the inner shell has a rim-side annular angle flange engaging around the raised rim.

In accordance with again an added feature of the invention, the outer shell has a characteristic frequency deviating significantly from double the frequency of a power supply to the furnace.

In accordance with a concomitant feature of the invention, the crucible has an interior, and the inner shell carries a thermally insulating lining facing the interior of the crucible.

Due to the fitting of the furnace cover with sound-attenuating material, due to a construction of the outer shell of the furnace cover which ensures that its characteristic frequency deviates significantly from double the frequency of the power supply to the furnace, and due to a relatively good seal between the furnace cover and the crucible rim, the sound radiation emitted from the furnace cover to the surroundings and from the inner crucible rim to the environment, is considerably reduced.

Other features which are considered as characteristic for the invention are set forth in the appended claims.

Although the invention is illustrated and described herein as embodied in an induction crucible furnace with an accessible furnace platform, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 19:
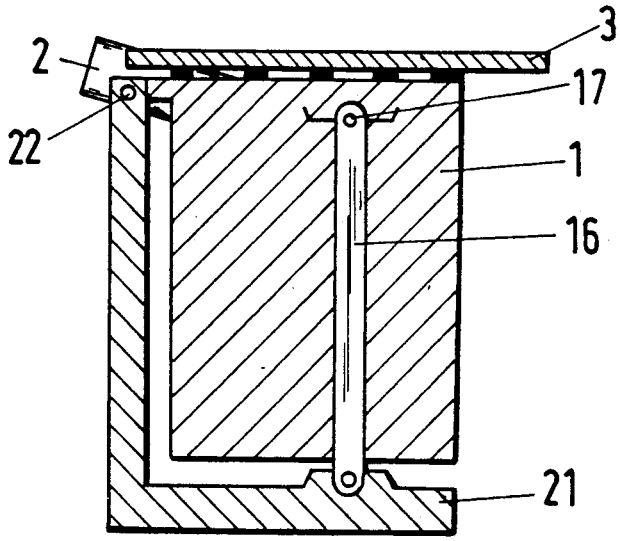
FIG. 19 is a sectional view of an induction crucible furnace according to the state of the art.

Referring now to the figures of the drawing in detail and first, particularly, to FIG. 19 thereof, there is seen a prior art induction crucible furnace which is formed of a tiltable furnace body 1 (with a frame, a crucible, a casting spout 2, a furnace coil and laminated packs), a tilting structure 21 and a furnace platform 3 being force-lockingly connected to the furnace body 1. Furnace tilting is effected by means of furnace-tilting cylinders 16 which are connected on one side through bearings 17 to the furnace body 1 and on the other side through further bearings to the tilting structure 21. In order to tilt the furnace, the furnace body 1 is connected through tilt bearings 22 to the tilting structure 21.

Figure 1:
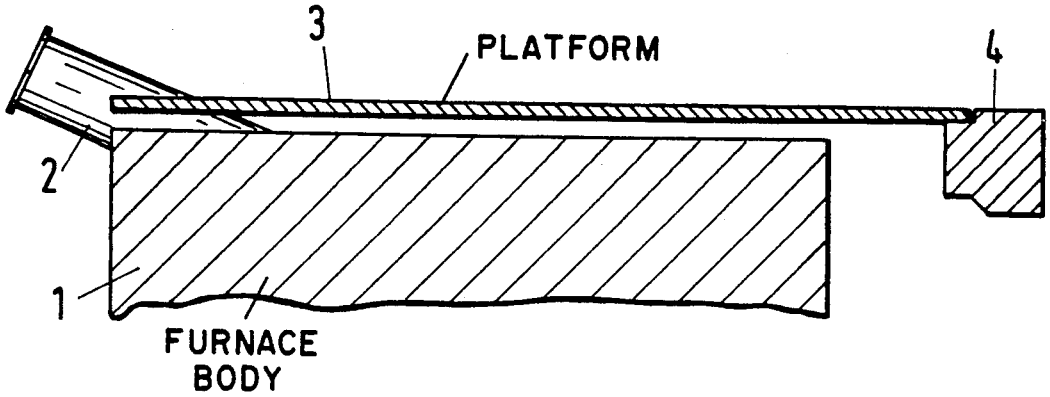
FIG. 1 is a fragmentary, diagrammatic, lateral-sectional view of an uncoupled configuration of a furnace platform.

FIG. 1 shows a lateral section of an uncoupled configuration of a furnace platform according to the invention. A tiltable furnace body 1 with a casting spout 2 formed in a front region thereof can be seen. An accessible furnace platform 3 that is located above the tiltable furnace body 1, is completely uncoupled in a normal or working position thereof from the tiltable furnace body 1. The furnace platform 3 has a back which is mounted on a platform 4 and at both sides of the furnace body 1 it is mounted on side walls 5 (which are not illustrated in FIG. 1) of a furnace box. The furnace body 1 is housed by the furnace box on at least two sides, while the back is covered by the platform 4. Alternatively, it is also possible to only support the furnace platform 3 on the two side walls 5 of the furnace box.

In the normal position, the material present in the crucible of the furnace body is melted by applying the highest power, which is the melting power, to the furnace. As can be seen, there is no direct vibration-transmitting, force-locking connection between the furnace body 1 and the furnace platform 3 which largely covers the furnace body 1, so that direct vibration transmission from the furnace body to the furnace platform is prevented.

In order to improve the sound attenuation, the side walls of the furnace box and, if appropriate, the platform 4 are faced with sound-absorbing material on surfaces thereof facing the furnace body.

Figure 2:
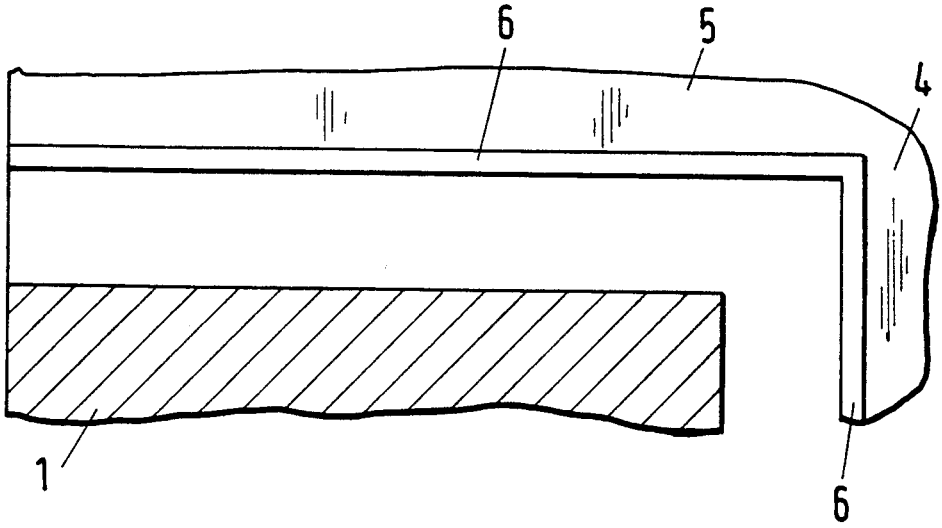
FIG. 2 is a fragmentary plan view of a configuration according to FIG. 1 with the furnace platform removed.

FIG. 2 shows a plan view of a configuration according to FIG. 1 with the furnace platform omitted. The tiltable furnace body 1, the side wall 5 of the furnace box and the back platform 4 can be seen. Support surfaces 6 for mounting the furnace platform 3 are provided both in the side walls 5 of the furnace box and in the platform 4. The furnace platform 3 covers the furnace and a free space between the furnace body 1 and the furnace box or the platform 4. In induction crucible furnaces of relatively low power, frequently no separate platform 4 is provided, but instead the furnace box also houses the back of the furnace body by means of a back wall. In this variant, the uncoupled furnace platform is accordingly supported on three sides on corresponding support surfaces 6 of the side walls of the furnace box.

In the embodiment shown in FIGS. 1 and 2, the manner in which the furnace platform 3 is to be actuated when the tiltable furnace body 1 is pivoted about the tilting axis located at the height of the casting spout 2, that is to say when it is in the tilting position, is left open. However, it is also expedient to tilt the furnace platform 3 when the furnace body 1 is tilted, with the tilting axes of the furnace body and of the furnace platform preferably being congruent. Three different uncoupling variants are described below, in which the motion is transmitted during tilting from the furnace body to the furnace platform by suitable coupling elements which allow a force transmission from the furnace body to the furnace platform during the tilting step, whereas this force-locking connection is undone in the normal position of the furnace. In this way, the coupling elements effect variable coupling between a state of close or rigid coupling during the tilting step and a state of very loose coupling or complete uncoupling in the normal position.

Figure 3:
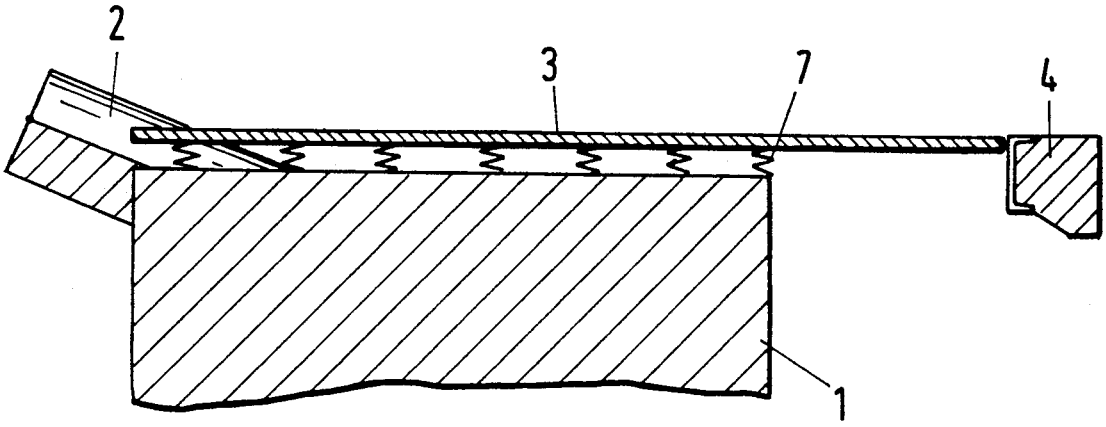
FIG. 3 is a view similar to FIG. 1 of a furnace platform uncoupled by means of spring elements.

In FIG. 3, a furnace platform that is uncoupled by means of spring elements is shown. In this first uncoupling variant, it is not necessary to mount the furnace platform 3 on support surfaces of the platform 4 and of the side walls 5 of the furnace box, but instead the furnace platform 3 is joined to the tiltable furnace body 1 through a plurality of spring elements 7 having appropriate spring characteristics. As a result of the spring characteristics of the spring elements 7, there is very loose coupling in the normal position of the furnace, and propagation of the vibrations from the furnace body 1 to the furnace platform is avoided. During tilting, close coupling between the furnace body and furnace platform is effected by the spring elements.

Figure 4:
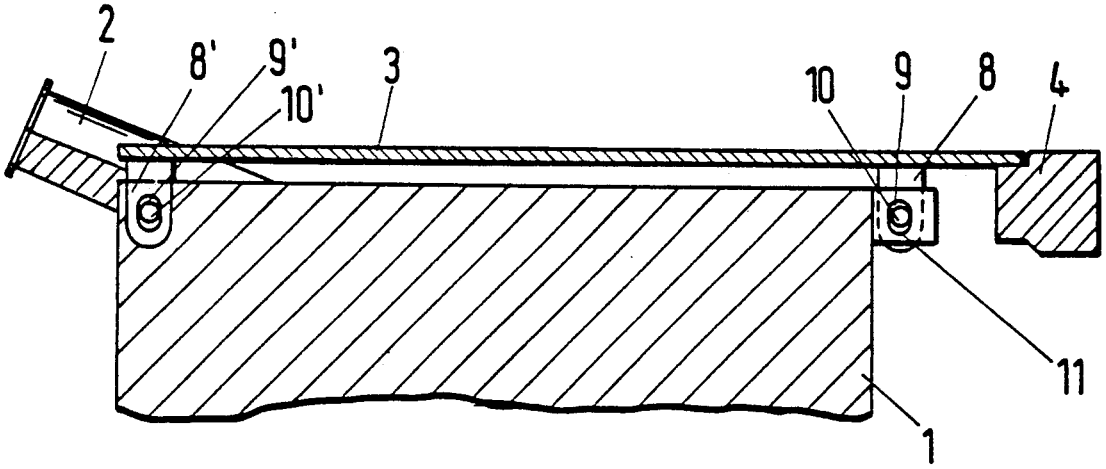
FIGS. 4, 5 are respective fragmentary lateral-sectional and plan views of a furnace platform uncoupled by means of lugs with slots.

In FIG. 4, a furnace platform that is uncoupled by means of lugs with slots is shown in a lateral section. In this second uncoupling variant, it is assumed that, with the furnace body 1 not tilted, the furnace platform 3 is supported on support surfaces 6 of the side walls 5 of the furnace box and, if appropriate, of the platform 4. On the lower surface of the furnace platform 3, there are lugs 8, 8' that are joined to the furnace platform itself and are provided with slots 9, 9'. Lugs 11 that are joined to the tiltable furnace body 1 and are likewise provided with slots 9, are disposed next to the lugs 8. The lugs 8 and 11 are mutually movably connected by a bolt 10 reaching through the slots 9. The lug/bolt/lug connections 8/10/11 described above are preferably located on the back of the tiltable furnace body 1.

In order to provide for mobile fixing of the furnace platform 3 to the two sides of the tiltable furnace body 1, bolts 10' are joined directly to the tiltable furnace body. These bolts 10' engage directly in slots 9' in the lugs 8' that are joined to the furnace platform 3.

With the furnace body 1 in the normal position, the lug/bolt/lug connections 8/10/11 and the lug/bolt connections 8'/10' between the furnace platform 3 and furnace body 1 are uncoupled, so that sound transmission is avoided. However, with the furnace body 1 tilted, the furnace platform 3 is directly connected to the tilted furnace body 1 by force-locking engagement of the connections 8/10/11 and 8'/10' and is held, so that the furnace body 1 can be tilted by 90° and more, with the furnace platform 3 also pivoting.

Generally, the variable coupling between the furnace body and the furnace platform is effected in the second uncoupling variant by the engagement of bolts fixed to one component (1 or 3) in slots of an element fixed to another component (1 or 3), namely in such a way that, in the normal position of the furnace, the force-locking connection between the furnace and the furnace platform is undone, whereas this force-locking connection is then automatically established upon tilting, after a short travel of the furnace body. This second uncoupling variant is possible if, upon tilting, the center of gravity of the furnace platform with its fixtures remains behind the tilting axis even at the largest tilting angle.

Figure 5:
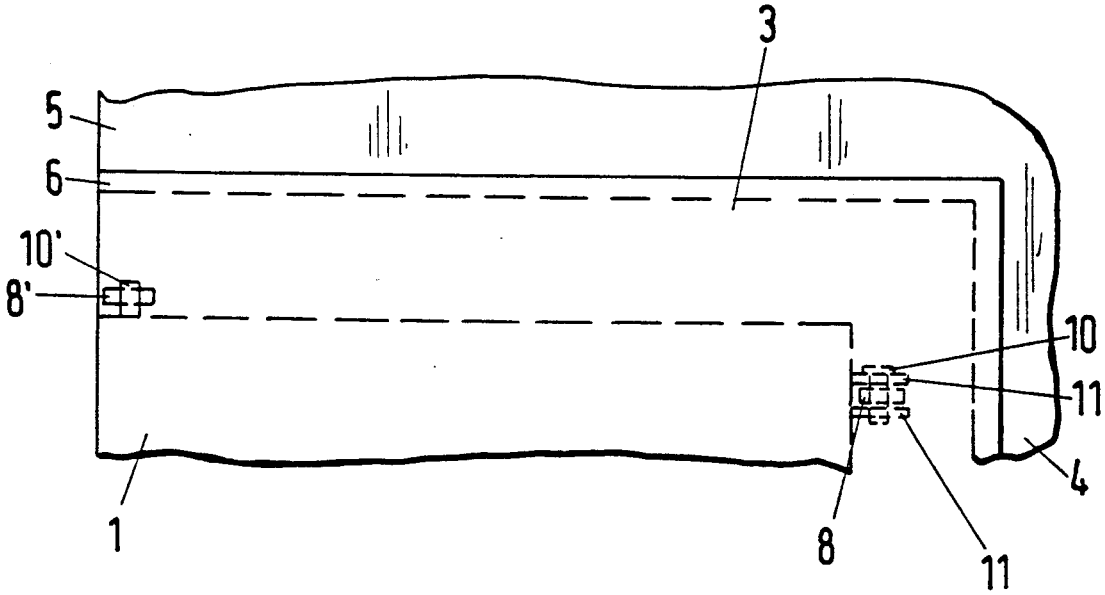

In FIG. 5, a furnace platform which is uncoupled by means of lugs with slots in accordance with the second uncoupling variant, is shown in a plan view. In detail, the lugs 8, 8' that are joined to the lower surface of the furnace platform 3, the lugs 11 that are joined to the furnace body 1, the bolts 10 reaching through the slots 9 in the lugs 8, 11 and the bolt 10' reaching into the slot 9' in the lug 8' and being joined to the furnace body 1, can be seen. The connections 8/10/11 and 8'/10' are each located in the free space between the furnace body 1 and the side walls 5 of the furnace box or platform 4.

Figure 6:
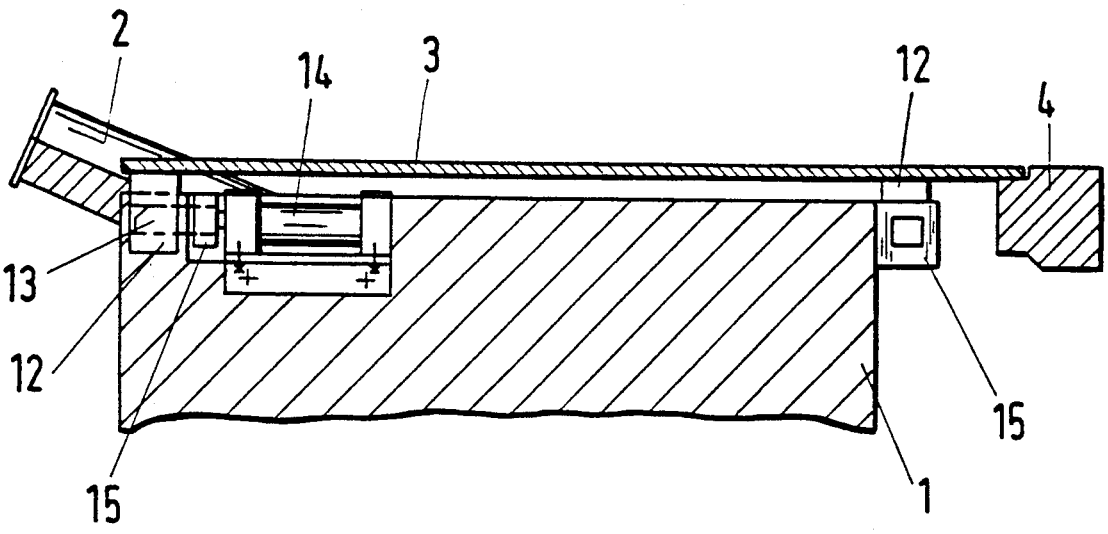
FIGS. 6, 7 are respective fragmentary lateral-sectional and plan views of a furnace platform uncoupled by means of mobile locking bolts.

FIG. 6 is a lateral section which shows a furnace platform that is uncoupled by means of mobile locking bolts. In this third uncoupling variant, it is also assumed that, with the furnace body 1 not tilted, the furnace platform 3 is supported on the support surfaces 6 of the side walls 5 of the furnace box and, if appropriate, on the support surfaces of the platform 4. In order to couple the furnace platform 3 and the tiltable furnace body 1, in each case a lug 12 that is joined to the furnace platform 3 and a lug 15 that is joined to the tiltable furnace body 1, are disposed side by side. Both of the lugs 12, 15 have bores formed therein through which a mobile locking bolt 13 of an air cylinder 14 can engage. The air cylinder 14 is fixed to the tiltable furnace body 1. Such lug/locking bolt connections 12/13/14/15 are disposed both on the side and on the back of the tiltable furnace body 1.

With the furnace body 1 in the normal position, the lug/locking bolt connections 12/13/14/15 between the furnace platform 3 and the furnace body 1 are uncoupled, so that sound transmission is avoided. Before the furnace body 1 is tilted, the air cylinders 14 are actuated, so that the locking bolts 13 each effect locking of the lugs 12 and 15 and therefore a connection of the furnace body and the furnace platform. As a result of this force-locking, the furnace platform 3 is borne by the furnace body 1 during the pivoting step.

The third uncoupling variant is also particularly suitable if, upon tilting, the center of gravity of the furnace platform with its fixtures does not remain behind the tilting axis. Generally, the variable coupling in this third uncoupling variant is effected by longitudinally displaceable locking bolts located on one part being anchored in corresponding holes of the other part before the start of the tilting step, so that a firm force-locking connection between the furnace body and the furnace platform is made, whereas in the normal position, these bolts are retracted and the force-locking connection is thus undone, resulting in the separation of the furnace body and the furnace platform, that is desired in this position.

Figure 7:
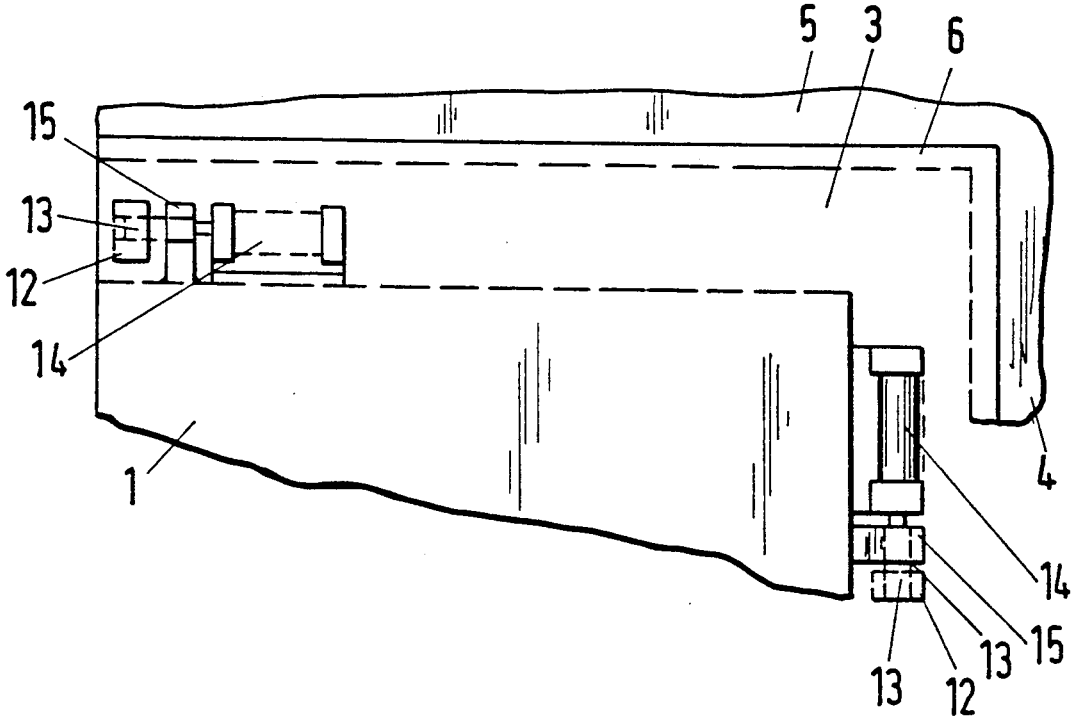

FIG. 7 is a plan view of a furnace platform which is uncoupled by means of mobile locking bolts, according to a third uncoupling variant. In detail, the lugs 12 that are joined to the furnace platform 3, the lugs 15 which are joined to the tiltable furnace body, the air cylinders 14 that are fixed to the furnace body 1 and the locking bolts thereof can be seen. The lug/locking bolt connections 12/13/14/15 are each located in the free space between the furnace body 1 and the side walls 5 of the furnace box or the platform 4. Expediently, at least one lug/locking bolt connection is located on each side and on the back of the furnace body 1.

Figure 8:
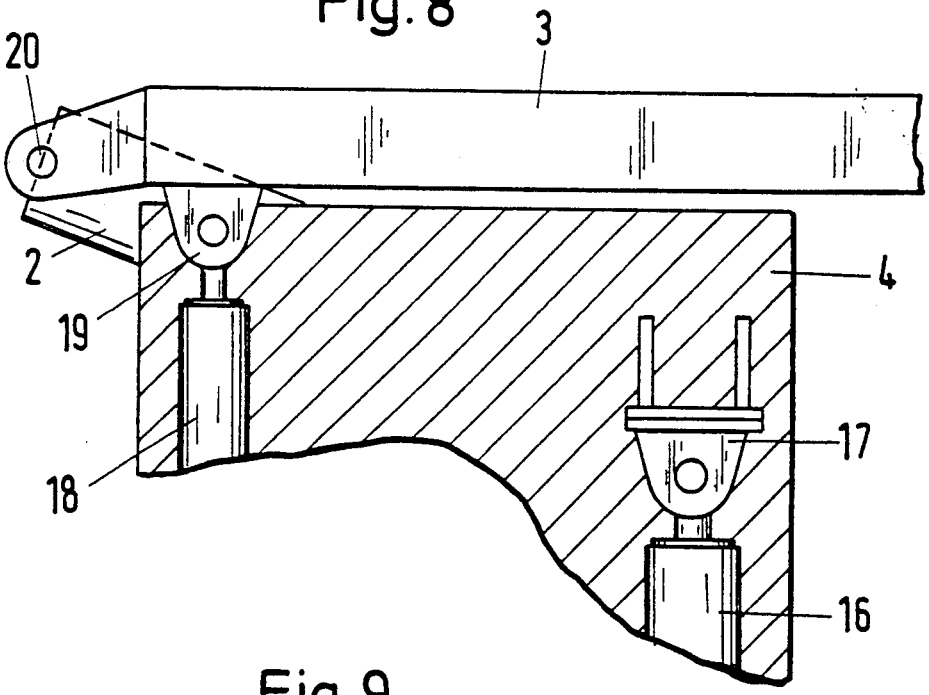
FIGS. 8, 9 are respective fragmentary side-elevational and front-elevational views of a furnace platform which is pivotable independently of the tiltable furnace body by means of a furnace platform-tilting cylinder.

In FIG. 8, a furnace platform which is pivotable independently of the tiltable furnace body by means of a furnace platform-tilting cylinder, is shown in a side view. The hydraulically actuated furnace-tilting cylinder 16 of the tiltable furnace body 1 is connected through the bearing 17 to the furnace body 1. In order to provide hydraulic actuation of the furnace platform, a furnace platform-tilting cylinder 18 is connected through a bearing 19 to the furnace platform 3. A congruent tilting axis 20, about which both the tiltable furnace body 1 and the furnace platform 3 pivot, is located at the height of the pouring port of the casting snout 2.

In this embodiment, the furnace platform is accordingly moved by one or two furnace platform-tilting cylinders 18 of its own, so that there is no force-locking contact between the furnace body and the furnace platform, even during tilting. This structure has advantages if the weight of the furnace body the and melt, and therefore ultimately the furnace content, are to be measured continuously even during tilting.

Figure 9:
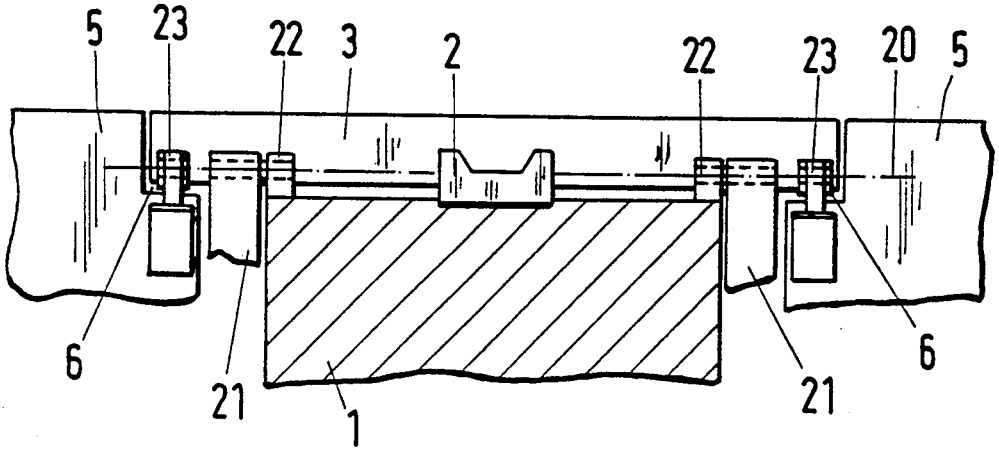

FIG. 9 is a plan view of a furnace platform which is pivotable independently of the tiltable furnace body by means of a furnace platform-tilting cylinder. The tiltable furnace body 1 has two furnace-tilt bearings 22 supported on a tilting structure 21 and the furnace platform 3 has two platform-tilt bearings 23 which are supported, for example, on the side walls 5 of the furnace box. The support surfaces 6 for the furnace platform 3, which are formed by the side walls 5 of the furnace box, are also shown. As can be seen, the congruent tilting axes 20 of the furnace body 1 and the furnace platform 3, pass through the furnace-tilt bearings 22, the platform-tilt bearings 23 and the pouring port of the casting spout 2.

In addition to FIG. 8, FIG. 9 indicates that the furnace-tilt bearings 22 and the platform-tilt bearings 23 are supported separately from one another, so that sound propagation through a common shaft of the two tilt bearings 22, 23 is avoided. Even though the tilting axes of the tilt bearings 22, 23 are congruent, no common shaft is used, but instead each tilt bearing 22, 23 has a separate shaft.

Figure 10:
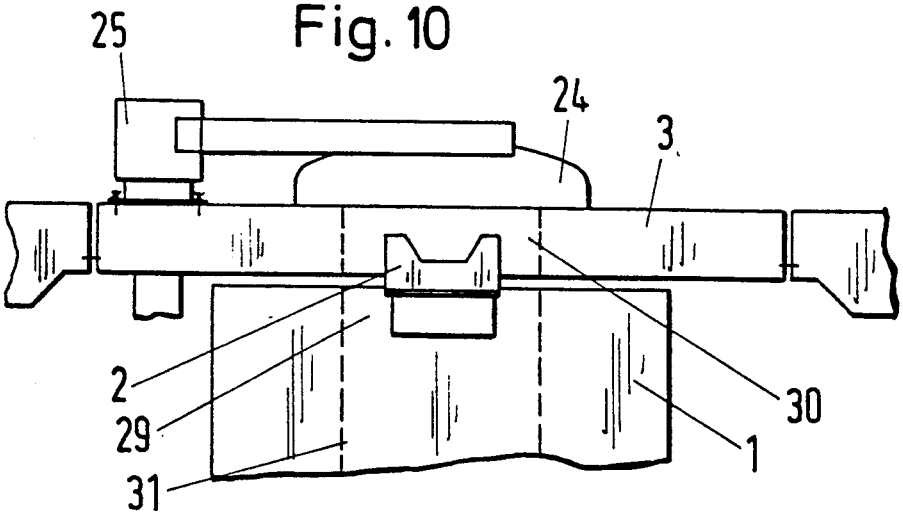
FIG. 10 is a fragmentary, elevational view of a furnace cover uncoupled from the tiltable furnace body.

In FIG. 10, a furnace cover that is uncoupled from the tiltable furnace body is shown. The tiltable furnace body 1 with a crucible 31, a crucible opening 29, the casting spout 2, the furnace platform 3 and a furnace cover 24 is shown. The furnace cover 24 covers an opening 30 in the furnace platform 3, which is located above the crucible opening 29. The opening and closing of the furnace cover 24 is effected by a cover drive 25 which is rigidly joined to the furnace platform 3. Both the furnace cover 24 and the cover drive 25 are completely uncoupled from the tiltable furnace body 1 and are anchored only by the furnace platform 3. The force-locking coupling described above between the furnace platform 3 and therefore the furnace cover 24 and the tiltable furnace body, arises only in the tilted position. As a result, a transmission of vibration from the furnace body to the cover is avoided in the normal position.

Figure 11:
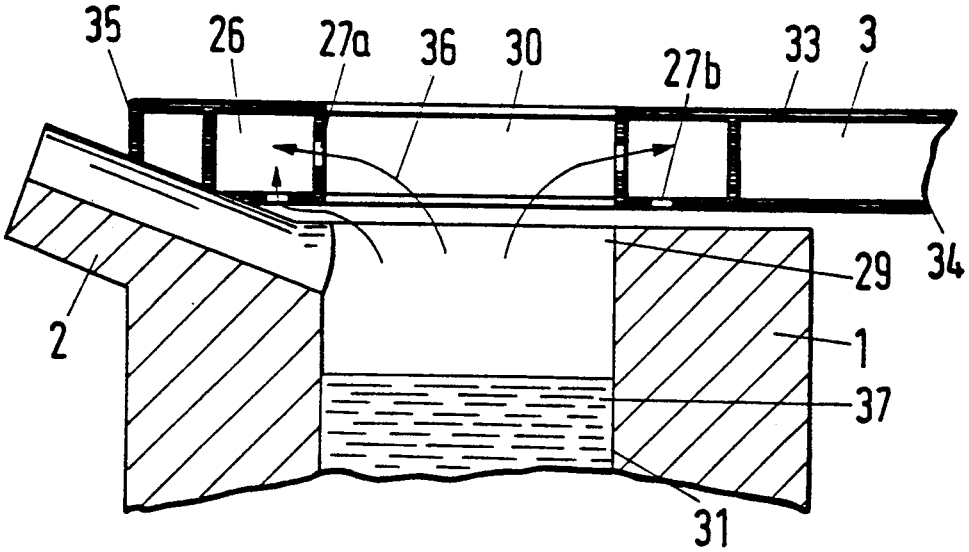
FIGS. 11, 12 are respective fragmentary lateral-sectional and plan views of a frame extraction integrated into the uncoupled furnace platform, with the cover plate removed.

In FIG. 11, a fume extractor integrated into the uncoupled furnace platform is shown in a lateral section. The tiltable furnace body 1 with the crucible 31, the crucible opening 29, the casting spout 2 and the furnace platform 3 can be seen. The furnace platform 3 is assembled like a box from a cover plate 33, a bottom plate 34 and side plates 35 and is expediently provided on its bottom plate 34 with sound-absorbing elements.

Disposed immediately above the crucible opening 29 is the opening 30 in the furnace platform 3, which can be closed by means of a non-illustrated cover. Since the furnace platform 3 is uncoupled from the tiltable furnace body, an interspace is formed between the furnace surface and the bottom plate 34 of the furnace platform 3. Formed around the opening 30 in the furnace platform is an annular channel 26 with a plurality of extraction orifices **27*a* in a side wall thereof facing the opening 30 and a plurality of extraction orifices 27*b* in a bottom wall thereof facing the furnace surface. Emissions 36 (fumes, dense smoke, dust) which are formed upon melting and which rise from the crucible opening 29, are extracted through the orifices 27*a, b* and taken away through a waste air line 32 shown in FIG. 12. The melt located in the crucible is indicated by reference numeral 37**.

Figure 12:
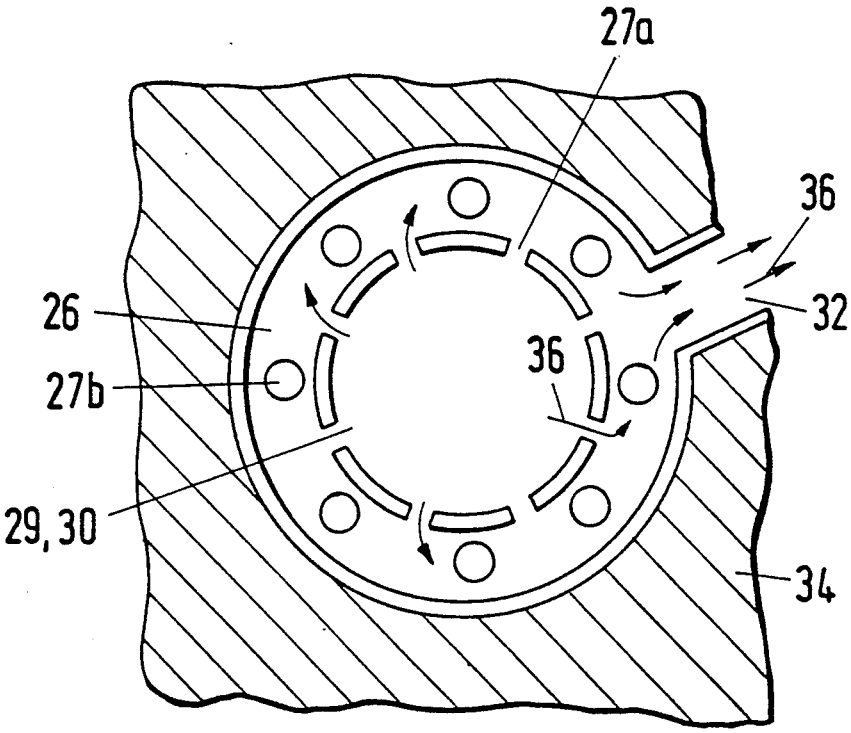

FIG. 12 shows a bottom plan view of a fume extractor which is integrated into the uncoupled furnace platform with the cover plate removed. The bottom plate 34 of the furnace platform 3 with the opening 30, and the annular channel 26 being formed around the opening 30 and having extraction orifices **27*a* in its side wall and extraction orifices 27*b* in its bottom wall, can be seen. The emissions 36 rising from the crucible 31 are extracted through the orifices 27*a, b,* into the annular channel 26 and taken away through the waste air line 32 connected to the annular channel 26**.

Figure 13:
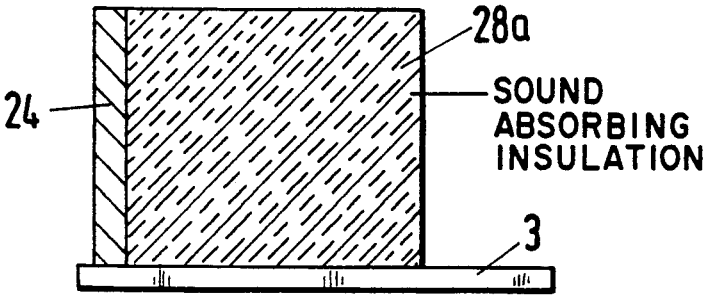
FIGS. 13, 14 are respective lateral-sectional and plan views of sound-insulating walls additionally fixed to the uncoupled furnace platform.

FIG. 13 shows a lateral section in which sound-insulating walls are additionally fixed to the uncoupled furnace platform. It is assumed in this case that, for a fusion procedure which is optimized in process terms, it may be necessary in the case of induction crucible furnaces with in-and-out operation for charging to be carried out even at full furnace power (the crucible is filled with further metallic feed materials), that is to say the furnace body is then in the normal position with an open cover. In order to obtain optimized noise attenuation even in this case, two or three vertical sound-insulating walls are built up on the furnace platform in accordance with a further variant. In the lateral section according to FIG. 13, only one sound-insulating wall **28*a* can be seen. The furnace cover 24** has an opening angle of 90°.

Figure 14:
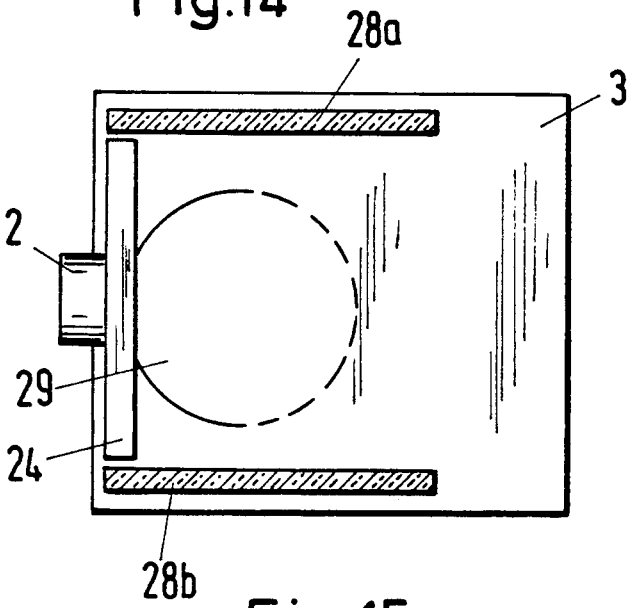

In FIG. 14, sound-insulating walls that are additionally fixed to the uncoupled furnace platform are shown in a plan view. Two fixed sound-insulating walls 28*a*, 28*b* are mounted vertically on the furnace platform 3 on either side of the crucible opening 29. The furnace cover 24 is in the opened condition or state with an opening angle of about 90°. The fully opened cover 24 advantageously takes care of the sound screening in the region of the end surface. Sound screening in the back region can be effected, for example, by an additional sound-insulating wall mounted on the furnace platform 3, by a separate sound-absorbing element fixed to a horizontally moving charging device or by a similar sound-insulating element (in this connection, see FIG. 16).

Figure 15:
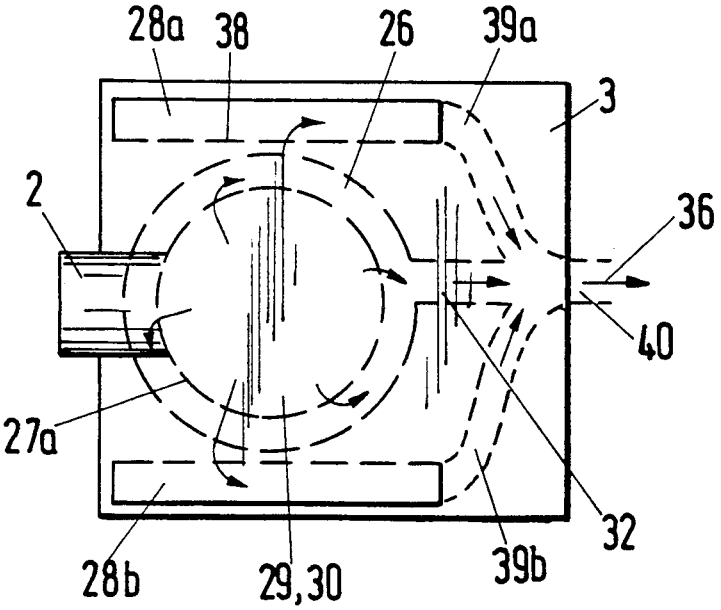
FIG. 15 is a plan view showing additional fume extraction through the sound-insulating walls.

FIG. 15 illustrates additional fume extraction through the sound-insulating walls. In this variant, the sound-insulating walls 28*a, b* not only serve for impeding the sound radiation but, furthermore, as extraction elements for the emissions 36 being formed upon melting and rising from the crucible when the furnace cover is open. For this purpose, the lateral surfaces of the sound-insulating walls 28*a, b* facing the crucible opening 29 are provided with extraction orifices 38, through which the emissions 36 are drawn out and taken away through waste air ducts 39*a, b*. The waste air ducts 39*a, b* for the sound-insulating walls 28*a, b* are advantageously located in the furnace platform 3 and can be combined with the waste air line 32 of the annular channel 26 to provide a header 40 that is likewise integrated into the furnace platform.

The use of the sound-insulating walls 28*a, b* as emission extraction elements is very effective above all in the case of relatively large furnace diameters, since the sound-insulating walls have a comparatively large vertical extent, which can be utilized for the extraction.

Figure 16:
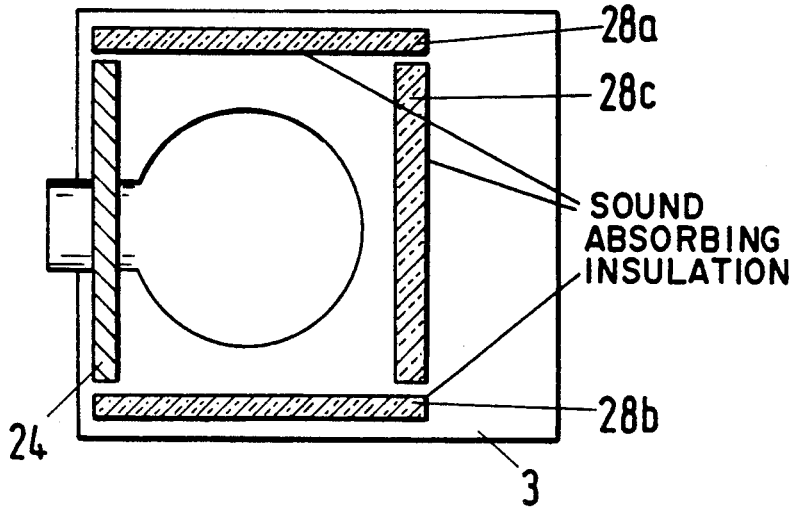
FIG. 16 is a plan view of a crucible opening vertically bounded on all sides by sound-absorbing components.

In FIG. 16, a crucible opening that is vertically bounded on all sides by sound-insulating components is shown in plan view. In addition to the two sound-insulating walls 28*a, b* and the cover 24, a further sound-insulating wall 28*c* is provided in the back region of the induction crucible furnace. This sound-insulating wall 28*c* can be rigidly mounted on the furnace platform 3 or, alternatively, it can be fixed to the charging device in the form of a sound-absorbing element, as was already indicated with regard to FIG. 14. Fixed mounting of the sound-insulating wall 28*c* on the furnace platform is possible only if the crucible is charged with metallic feed material from above by using a magnetic plate or a skip. The result of the variant shown in FIG. 16 is an optimized impediment of the sound emission arising when the cover 24 is open. The sound-insulating wall 28*c* can additionally also be provided with orifices for fume extraction, as described in connection with FIG. 15 for the sound-insulating walls 28*a, b*.

Figure 17:
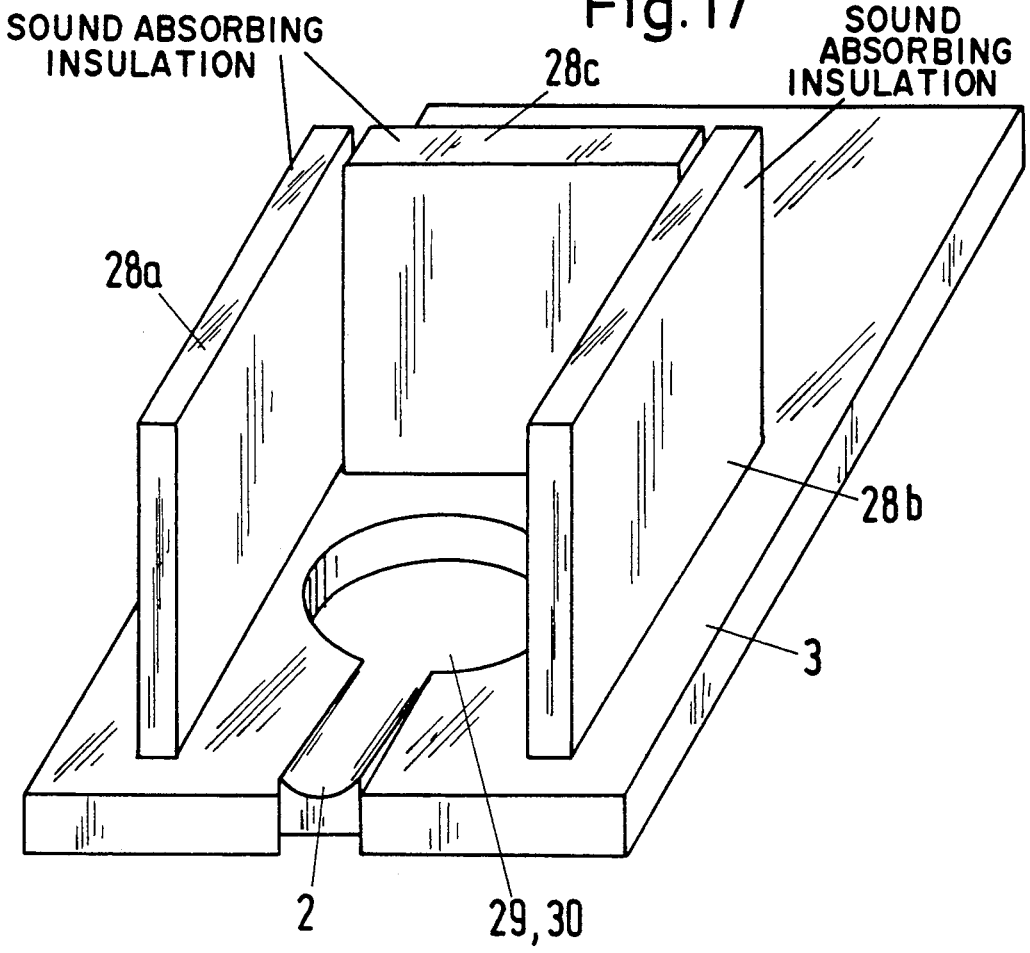
FIG. 17 is a perspective view of a furnace platform provided with sound-insulating walls.

In FIG. 17, a perspective view of a furnace platform provided with sound-insulating walls is shown. The three sound-insulating walls 28*a*, 28*b*, 28*c* can be seen. For the sake of clarity, the furnace cover is not shown. The sound intensity emitted at the crucible opening 29 o at the opening 30 in the furnace platform is considerably reduced by the sound-insulating walls 28*a, b, c*.

Figure 18:
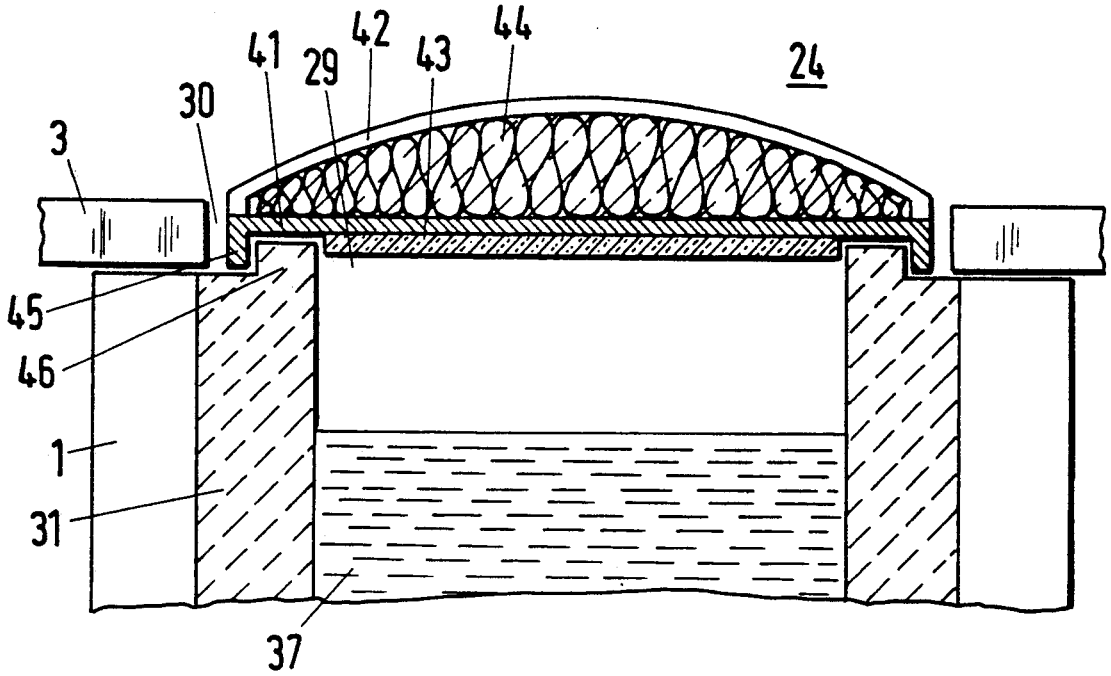
FIG. 18 is a fragmentary, sectional view of a furnace cover for an induction crucible furnace.

FIG. 18 shows a furnace cover for an induction crucible furnace. The tiltable furnace body 1 with the crucible 31, the crucible opening 29 and a melt 37 can be seen. The furnace body 1 is covered by the accessible furnace platform 3 which has the opening 30 formed directly above the crucible opening 29. Expediently, the furnace platform 3 is sonically uncoupled from the furnace body 1 in the normal position (without tilting) and is supported on the side walls of the furnace box that houses the induction crucible furnace and on the back platform. The lower surface of the furnace platform is expediently provided with sound-absorbing elements. The furnace opening 29 can be covered by the preferably square furnace cover 24.

The furnace cover 24 has a twin-shell construction which is formed of an inner shell 41 facing the crucible opening 29 and an outer shell 42 which is solidly joined to the inner shell. The inner shell carries a thermally insulating lining 43 which slightly protrudes into the crucible opening 29. A space formed between the inner shell 41 and the outer shell 42 is filled with sound-attenuating material 44. In order to ensure sealing of the closed furnace cover against emissions that are formed upon melting, such as fumes, dense smoke and dust, and against the sound energy produced during melting in the interior of the crucible, the inner shell 41 is provided with a rim-side annular angle flange 45 which engages around a raised rim 46 of the crucible 31. In this way, the sealing area of the closed cover is increased.

In order to provide effective prevention of sound transmission from the outer shell 42 of the furnace cover 24 to the environment, in addition to the sound-attenuating material provided within the furnace cover, it is important to ensure that the outer shell is constructed in its dimensions, its shaping and its wall thickness in such a way that its characteristic frequency deviates significantly from double the frequency of the power supply to the furnace, that is to say the frequency of the alternating voltage being set by the power converter and applied to the furnace coil. It can be assumed in this case that double the frequency of the power supply to the furnace represents the component which is essential with respect to sound generation. In medium-frequency induction crucible furnaces, double the frequency of the alternating voltage corresponds to a frequency range between 200 and 2000 Hz, which accordingly should be avoided. The characteristic frequency of the outer shell 42 should therefore deviate considerably from the range of 200 to 2000 Hz.

A furnace cover that is constructed as described above is suitable not only for attenuating the sound energy arising within the crucible with the cover closed (especially in the normal position, in which the material present in the crucible of the furnace body is melted by applying the highest power, namely the melting power, to the furnace), but is furthermore also suitable in conjunction with further sound-attenuating measures, for effectively attenuating the sound energy emitted from the crucible to the environment when the furnace cover is opened. As further sound-attenuating measures, three sound-insulating walls can, for example, be fixed on either side of the furnace cover and on the back on the upper side of the furnace platform, as was described above under FIG. 16, so that the opening 30 of the furnace platform, including the opened furnace cover preferably extending upright on the furnace platform, is vertically surrounded on all sides by the sound-absorbing elements which impede sound radiation.

Of course, embodiments of the induction furnace are also possible in which means for direct extraction of the emissions formed upon melting and escaping through the crucible opening, such as fumes, dense smoke and dust, are provided without the furnace platform being sonically uncoupled from the furnace body in the untilted normal position. Preferably, the means for direct extraction of the emissions are integrated in the furnace platform covering the furnace body or are at least connected to this furnace platform.

Likewise, embodiments of the induction crucible furnace are possible, which include means for attenuating the sound energy emanating from the crucible when the furnace cover is open, without the furnace platform being sonically uncoupled from the furnace body in the untilted normal position. Preferably, sound-insulating walls are fixed on the upper surface or side of the furnace platform around the opening formed therein which is located above the crucible opening.

Embodiments of the induction crucible furnace are also possible, in which the furnace cover is provided with sound-attenuating means for attenuating the sound energy produced in the crucible without the furnace platform being sonically uncoupled from the furnace body in the untilted norma position. Preferably, the furnace cover is of twin-shell construction, with sound-attenuating material being introduced between the inner shell and the outer shell.

We claim:

1. An induction crucible furnace assembly, comprising an induction crucible furnace having a furnace body to be moved between a normal untilted position and a tilted position, said furnace body having a crucible, an accessible furnace platform for covering said furnace body, means for sonically uncoupling said furnace platform from said furnace body in the normal position, coupling elements disposed between said furnace body and said furnace platform, said coupling elements effecting a change of state between a very loose coupling or complete uncoupling in the normal position and a close or rigid coupling in the tilted position of said furnace body, said coupling elements being spring elements having spring characteristics automatically effecting the very loose coupling in the normal position and the close coupling in the tilted position.

2. The induction crucible furnace assembly according to claim 1, including a furnace box housing said induction crucible furnace, said furnace box having side walls supporting said furnace platform in the normal position.

3. The induction crucible furnace assembly according to claim 2, wherein said induction crucible furnace has a back platform additionally supporting said furnace platform in the normal position.

4. An induction crucible furnace assembly, comprising an induction crucible furnace having a furnace body to be moved between a normal untilted position and a tilted position, said furnace body having a crucible, an accessible furnace platform for covering said furnace body, means for sonically uncoupling said furnace platform from said furnace body in the normal position, coupling elements disposed between said furnace body and said furnace platform, said coupling elements effecting a change of state between a very loose coupling or complete uncoupling in the normal position and a close or rigid coupling in the tilted position of said furnace body, said coupling elements being lug and bolt connections for interconnecting two components in the form of said furnace body and said furnace platform, said lug and bolt connections including lugs each having a slot formed therein and each being fixed to one of said components and bolts being joined to the other of said components and engaging in said slots, for automatically connecting said components with said bolt, said slot and said lug by tilting said furnace body, and for uncoupling said components in the normal position.

5. An induction crucible furnace assembly, comprising an induction crucible furnace having a furnace body to be moved between a normal untilted position and a tilted position, said furnace body having a crucible, an accessible furnace platform for covering said furnace body, means for sonically uncoupling said furnace platform from said furnace body in the normal position, coupling elements disposed between said furnace body and said furnace platform, said coupling elements effecting a change of state between a very loose coupling or complete uncoupling in the normal position and a close or rigid coupling in the tilted position of said furnace body, said coupling elements being lug, bolt and lug connections each including a first lug having a first slot formed therein and being fixed to said furnace platform a second lug opposite said first lug having a second slot formed therein and being fixed to said furnace body and a bolt engaging in said first and second slots, for automatically connecting said furnace body and said furnace platform with said first lug, said first slot, said bolt, said second slot and said second lug by tilting said furnace body, and for uncoupling said furnace body and said furnace platform in the normal position.

6. An induction crucible furnace assembly, comprising an induction crucible furnace having a furnace body to be moved between a normal untilted position and a tilted position, said furnace body having a crucible, an accessible furnace platform for covering said furnace body, means for sonically uncoupling said furnace platform from said furnace body in the normal position, coupling elements disposed between said furnace body and said furnace platform, said coupling elements effecting a change of state between a very loose coupling or complete uncoupling in the normal position and a close or rigid coupling in the tilted position of said furnace body, said coupling elements being lug and locking bolt connections for interconnecting two components in the form of said furnace body and said furnace platform, said lug and locking bolt connections including a longitudinally mobile locking bolt joined to one of said components and a lug being fixed to the other of said components and having a bore formed therein in which said locking bolt engages, for connecting said furnace body and said furnace platform during tilting of said furnace body and for disconnecting said furnace body and said furnace platform in the normal position by retraction of said locking bolt.

7. The induction crucible furnace assembly according to claim 6, including an air cylinder having said locking bolt.

8. The induction crucible furnace assembly according to claim 1, wherein said furnace body and said furnace platform each have a mutually independently operable tilting device.

9. The induction crucible furnace assembly according to claim 8, wherein said tilting devices are tilting cylinders.

10. The induction crucible furnace assembly according to claim 8, wherein said tilting devices for said furnace body and said furnace platform have separate tilt bearings being supported separately and having mutually independent tilting axes.

11. The induction crucible furnace assembly according to claim 10, wherein said tilting axes are congruent.

12. The induction crucible furnace assembly according to claim 1, wherein said furnace platform has a lower surface with sound-absorbing elements.

13. The induction crucible furnace assembly according to claim 1, including a furnace cover having a cover drive being supported on said furnace platform and being uncoupled from said furnace body in the normal position.

14. An induction crucible furnace assembly, comprising an induction crucible furnace having a furnace body to be moved between a normal untilted position and a tilted position, said furnace body having a crucible, an accessible furnace platform for covering said furnace body, means for sonically uncoupling said furnace platform from said furnace body in the normal position, said crucible having a crucible opening formed therein, said furnace platform having an opening formed therein above said crucible opening for extracting emissions being formed upon melting, said furnace platform having an annular channel integrated therein around said opening in said furnace platform, and said furnace platform having an upper surface and sound-insulating walls fixed to said upper surface around said opening in said furnace platform.

15. The induction crucible furnace assembly according to claim 14, wherein said annular channel has side and bottom walls and extraction orifices formed in at least one of said walls.

16. The induction crucible furnace assembly according to claim 14, including a waste air line integrated into said furnace platform, said annular channel leading into said waste air line for removing the extracted emissions.

17. The induction crucible furnace assembly according to claim 14, wherein said sound-insulating walls are vertically fixed on said furnace platform.

18. The induction crucible furnace assembly according to claim 14 including a furnace cover having a cover drive being supported on said furnace platform and being uncoupled from said furnace body in the normal position, two of said sound-insulating walls being disposed on either side of said furnace cover, and said furnace cover forming a further sound-insulating wall when opened.

19. The induction crucible furnace assembly according to claim 18, wherein said furnace cover extends upright when opened.

20. The induction crucible furnace assembly according to claim 18, including an additional sound-insulating wall being fixed to said upper surface of said furnace platform opposite said furnace cover, for impeding sound radiation on all sides with said furnace cover open.

21. The induction crucible furnace assembly according to claim 18, including an additional sound-absorbing element being fixed to a charging device for said induction crucible furnace at a location opposite said furnace cover, for impeding sound radiation on all sides with said furnace cover open.

22. The induction crucible furnace assembly according to claim 14, wherein said sound-insulating walls have extraction orifices formed therein for extracting the emissions being formed upon melting.

23. The induction crucible furnace assembly according to claim 17, wherein said sound-insulating walls have extraction orifices formed therein for extracting the emissions being formed upon melting.

24. The induction crucible furnace assembly according to claim 18, wherein said sound-insulating walls have extraction orifices formed therein for extracting the emissions being formed upon melting.

25. The induction crucible furnace assembly according to claim 20, wherein said sound-insulating walls have extraction orifices formed therein for extracting the emissions being formed upon melting.

26. The induction crucible furnace assembly according to claim 22, wherein said furnace platform has waste air ducts integrated therein for removing the emissions extracted through said sound-insulating walls.

27. The induction crucible furnace assembly according to claim 23, wherein said furnace platform has waste air ducts integrated therein for removing the emissions extracted through said sound-insulating walls.

28. The induction crucible furnace assembly according to claim 24, wherein said furnace platform has waste air ducts integrated therein for removing the emissions extracted through said sound-insulating walls.

29. The induction crucible furnace assembly according to claim 25, wherein said furnace platform has waste air ducts integrated therein for removing the emissions extracted through said sound-insulating walls.

30. An induction crucible furnace assembly, comprising an induction crucible furnace having a furnace body to be moved between a normal untilted position and a tilted position, said furnace body having a crucible, an accessible furnace platform for covering said furnace body, means for sonically uncoupling said furnace platform from said furnace body in the normal position, said crucible having a crucible opening formed therein, said furnace platform having an opening formed therein above said crucible opening for extracting emissions formed upon melting, said furnace platform having an annular channel integrated therein around said opening in said furnace platform, and including a waste air line integrated into said furnace platform, said annular channel leading into said waste air line for removing the extracted emissions, said furnace platform having waste air ducts integrated therein for removing the emissions extracted through said sound-insulating walls, and said furnace platform having a common header integrated therein, into which said waste air line and said waste air ducts lead.

31. The induction crucible furnace assembly according to claim 13, wherein said furnace cover has means for attenuating sound energy generated in said crucible.

32. The induction crucible furnace assembly according to claim 13, wherein said furnace cover has a twin-shell construction with an inner shell, and outer shell and sound-attenuating material disposed between said shells.

33. An induction crucible furnace assembly, comprising an induction crucible furnace having a furnace body to be moved between a normal untilted position and a tilted position, said furnace body having a crucible, an accessible furnace platform for covering said furnace body, means for sonically uncoupling said furnace platform from said furnace body in the normal position, and a furnace cover having a cover drive supported on said furnace platform and being uncoupled from said furnace body in the normal position, said furnace cover has a twin-shell construction with an inner shell, an outer shell and sound-attenuating material disposed between said shells, said crucible having a crucible opening formed therein and a raised rim at said crucible opening, and said inner shell having a rim-side annular angle flange engaging around said raised rim.

34. An induction crucible furnace assembly, comprising an induction crucible furnace having a furnace body to be moved between a normal untilted position and a tilted position, said furnace body having a crucible, an accessible furnace platform for covering said furnace body, means for sonically uncoupling said furnace platform from said furnace body in the normal position, and a furnace cover having a cover drive supported on said furnace platform and being uncoupled from said furnace body in the normal position, said furnace cover has a twin-shell construction with an inner shell, and outer shell and sound-attenuating material disposed between said shells, said outer shell having a characteristic frequency deviating significantly from double a frequency of a power supply to said furnace.

35. The induction crucible furnace assembly according to claim 32, said crucible has an interior, and said inner shell carries a thermally insulating lining facing the interior of said crucible.

* * * * *